US010166485B2

(12) United States Patent
Girlya et al.

(10) Patent No.: US 10,166,485 B2
(45) Date of Patent: Jan. 1, 2019

(54) DUMP TRAILER AMUSEMENT RIDE

(71) Applicant: Diggerland USA, LLC, West Berlin, NJ (US)

(72) Inventors: Ilya Girlya, West Berlin, NJ (US); Yan Girlya, West Berlin, NJ (US)

(73) Assignee: Diggerland USA, LLC, West Berlin, NJ (US)

( * ) Notice: Subject to any disclaimer, the term of this patent is extended or adjusted under 35 U.S.C. 154(b) by 0 days.

(21) Appl. No.: 15/391,880

(22) Filed: Dec. 28, 2016

(65) Prior Publication Data

US 2018/0178135 A1 Jun. 28, 2018

(51) Int. Cl.
*A63G 31/16* (2006.01)
*A63G 31/14* (2006.01)
*A63G 31/00* (2006.01)

(52) U.S. Cl.
CPC ..... *A63G 31/14* (2013.01); *A63G 31/16* (2013.01); *A63G 2200/00* (2013.01)

(58) Field of Classification Search
CPC . A63G 1/00; A63G 1/30; A63G 31/00; A63G 31/02; A63G 31/16; F23L 17/00; F23L 17/02; B06J 7/00
USPC ..... 472/43–45, 59–60, 130
See application file for complete search history.

(56) References Cited

U.S. PATENT DOCUMENTS 3,468,533 A * 9/1969 House, Jr. ..... A63G 31/16 434/34
3,711,990 A * 1/1973 Pfeilsticker ..... A63H 17/06 446/428
4,090,436 A * 5/1978 Wright ..... B60H 1/262 454/136
5,054,377 A * 10/1991 Mochel ..... B60H 1/262 296/217
5,316,480 A * 5/1994 Ellsworth ..... A63G 31/16 434/29
5,947,502 A * 9/1999 Kammerzell ..... B60P 3/0252 108/143
8,241,133 B1 * 8/2012 Lewis ..... A63G 31/16 104/53
8,506,301 B2 * 8/2013 Jaszlics, IV ..... G09B 9/00 434/29

(Continued)

*Primary Examiner* — Kien Nguyen
(74) *Attorney, Agent, or Firm* — Derek Pressley

(57) ABSTRACT

This invention is an amusement ride, attraction or device comprising a modified vehicle, machine, vessel, container, load-carrying platform or similar device, or any combination thereof, or anything having the appearance thereof, which is used, useful or operated for mining, transportation, military or construction or other commercial or industrial uses, purposes or applications. Illustrative embodiments of this invention include a modified dump trailer, dump truck or load-carrying platform. Such a modified dump trailer includes a dump trailer modified so as to permit a horizontally-pivoting telescoping hydraulic cylinder to raise and lower the front of the modified dump trailer, which is modified with a passenger support system and a passenger restraint system. The invention may involve application of other devices, machines, means or forces. Associated processes, systems and methods include a power pack or other dedicated source of energy and an adjacent entrance/exit ramp and boarding/de-boarding platform and operator control platform.

3 Claims, 15 Drawing Sheets

(56) References Cited

U.S. PATENT DOCUMENTS

| | | | | |
|---|---|---|---|---|
| 8,678,941 | B2 * | 3/2014 | Bilsen | A63J 1/00<br>446/427 |
| 2010/0123330 | A1 * | 5/2010 | Watts | B60P 1/435<br>296/61 |

* cited by examiner

DUMP TRAILER AMUSEMENT RIDE

REFERENCE TO RELATED APPLICATIONS

This is a first-filed invention.

BACKGROUND OF THE INVENTION

The present invention is in the field of amusement rides, attractions and devices. In particular, the present invention is in the field of amusement rides, attractions and devices comprising a modified vehicle, machine, vessel, container or platform.

Amusement parks and theme parks continuously face challenges attracting return visitors and new visitors. Past visitors may not elect to return, and potential new visitors may not elect to travel to a park that, in their opinion, does not regularly offer guest experience components that are new, innovative or different relative to those of other parks. To be successful, parks need to regularly introduce new, innovative and fun guest experiences. An objective of this invention is to provide an amusement ride, attraction or device that is new, innovative and fun and different relative to prior art attractions.

An additional objective of the present invention is to provide an amusement ride, attraction or device that is sufficiently mobile to be transported (including by any truck, tractor or other vehicle, machine, vessel or container, or any combination thereof) such as for use in or by a temporary or traveling carnival or amusement event or location, or at any other temporary location such as a parking area or common area of a commercial (e.g., office, warehouse or mixed-use), retail (e.g., mall or other shopping center) or institutional (e.g., governments, school hospital, heath care, etc.) property, such as for a temporary amusement attraction as part of a gathering, party, fundraiser or other event.

Similar machines may be similarly modified according to the present invention for use as an amusement ride, attraction or device.

Accordingly, embodiments herein illustrate the principles, preferred or example embodiments, and modes of assembly and operation, of the invention; however, the invention is not, and shall not be construed as being exclusive or limited to the specific or particular embodiments herein. Moreover, certain specific or particular embodiments herein have been expressly designated optional, and thus the invention includes the invention with, or without, any or all embodiments herein expressly designated as optional. Accordingly, all embodiments herein should be regarded as illustrative rather than exclusive or limiting, and variations to embodiments herein may be made without departing from the invention scope.

This invention is useful, to an amusement park or a theme park that wishes to offer this invention as an amusement ride, attraction or device or in or by a temporary or traveling use, as noted above, because prior art amusement rides, attractions and devices have not focused on invention of a modified trailer or similar machine operated for amusement. The embodiments of the present invention make reference to several vehicles or machines in the prior art. The features of some representatives of such vehicles or machines are given as following.

Reference to prior art may be made for embodiments in the present invention that constitute a dump trailer or a trailer. Trailers are typically wheeled containers pulled by a truck tractor. A truck tractor is a highway vehicle, capable of being driven with or without a trailer attached, which is typically a two- or three-axle chassis with driver's cab, engine, drivetrain and trailer hitch and other trailer connectors. The trailer is the container structure supported by the trailer frame, which is supported by the axle, wheel and tire assemblies. The trailer container is sometimes referred to as the trailer's "body" or "bed" and is attached to and above the trailer's frame.

Types of trailers include open-top, dry-freight trailers, the design of which may include aluminum sides supported by interior posts made of aluminum, fiberglass-reinforced plywood or other material, and enclosed containers, which may be used in intermodal transportation, e.g., railway or waterway transportation before or after highway transportation. A type of open-top trailer is a dump trailer.

A dump trailer has one end or side that can be raised and lowered, and an opposing end or side with a gate or other device that can be raised, lowered or otherwise opened and closed to permit dumping of the body's load. A dump trailer is capable of dumping the container contents, typically by elevating or pivoting one end or side of the container to allow the container load to flow out of the container through a gate or similar structure or device at the opposing end, by gravity alone or aided by an optional vibrator. A dump trailer may be used to haul bulk materials, commodities or products, such as dirt, sand, gravel, rock, salt, trash, debris, refuse, scrap, by-products and raw, agricultural, mining, transportation, construction, paving or other materials, etc.

Reference to prior art may be made for embodiments that constitute a dump truck. A dump truck is typically a truck with an open-top body used to haul bulk materials, commodities or products, such as dirt, sand, gravel, rock, salt, trash, debris, refuse, scrap, by-products and raw, agricultural, mining, transportation, construction, paving or other materials, etc. Typically, the body is hinged, can be raised or lowered by hydraulic cylinder, is equipped with a tail gate or other device that can be raised, lowered or otherwise opened and closed, typically by hydraulic cylinder, to permit dumping of the load by gravity flow or mechanically-assisted means from the body through the body's open/deployed tail gate opening.

Reference to prior art may be made for embodiments that constitute a load-carrying platform. Load-carrying platforms are typically transportable. Transportable, load-carrying platforms may be a flat rack logistics platform suitable for transportation of non-containerized items or may have mounted on the base at least one support frame that may be adjusted to different positions. Transportable load-carrying platforms may be used to support shipping of heavy or irregularly-shaped cargo that is not containerized, i.e., cargo that is not loaded into a shipping container.

Although the appearance, utility, and modes of operation of above-referenced vehicles or machines may be of interest to many people, especially to children, they are generally not suitable as an amusement, entertainment or educational experience in an amusement park or similar setting, without modification for compliance with applicable regulatory and safety requirements. Thus, one of the objectives of the present invention is to address these limitations of these vehicles and machines in prior art so as to create the opportunity for riders to enjoy and experience these vehicles and machines in a fun, safe and exciting manner, as an amusement, entertainment and educational experience in an amusement park or similar setting.

Reference to prior art may be made for embodiments that constitute a passenger seating system and a passenger restraint system as illustrated herein or for embodiments that constitute alternatives to such embodiments including such embodiments as illustrated herein. For example, alternative passenger seating systems may include alternative seating arrangements, systems or methods or alternative means of passenger seating system fabrication, assembly or installation. Additionally, in lieu of seating, alternative passenger support systems include horizontal, vertical or angled poles, columns or similar devices or structures, with or without fixed or flexible hand grips, wrist straps or similar devices or structures, to enable standing passengers to generally stabilize their balance and their position in the passenger containment or compartment section. Additionally, in lieu of the passenger restraint system as illustrated herein, an alternative passenger restraint system may include an alternative harness to the five-point harness illustrated herein or an alternative type of harness, seatbelt, lap bar, shoulder restraint, torso restraint, or any other type of restraining device or system.

Reference to prior art may be made for embodiments that constitute various hydraulic control systems or components thereof, which include a pump, valve or similar or related devices, to deliver a source of pressurized fluid to a fluid-operable actuating or load-sustaining telescoping hydraulic cylinder or similar or related devices.

SUMMARY OF THE INVENTION

The invention comprises a modified vehicle, machine, vessel, container, load-carrying platform or similar device, or any combination thereof, or anything having the appearance thereof, such as a dump trailer, dump truck or load-carrying platform, which is used, useful or operated for mining, transportation, military or construction or other commercial or industrial uses, purposes or applications but which is instead used, useful or operated as an amusement ride, attraction or device. Illustrative embodiments of this invention include a modified dump trailer, a modified dump truck, and a modified transportable load-carrying platform. One such illustrative embodiment of this invention includes a dump trailer modified so as to permit a horizontally-pivoting telescoping hydraulic cylinder to raise and lower the front of the modified dump trailer, which is modified with passenger seating, columns or other types of support, and with a passenger restraint system, so that the passengers experience the vertical pivoting movement of the passenger containment or compartment section of the modified dump trailer and a view from inside the of the passenger containment or compartment section through the dump trailer body's open/deployed tail gate opening. The invention is not limited or restricted to use of a hydraulic cylinder. The invention may involve application of other devices, machines, means or forces, including gravitational, inertial, mechanical, chemical, electrical, magnetic, electromagnetic, thermal, nuclear, thermonuclear, wind, solar, inversion and other means or forces, presently known, unknown, discovered or undiscovered, to raise, lift, lower, push, pull, move, force, propel or otherwise move or cause movement of it. Associated processes, systems and methods include a power pack or other dedicated source of energy and an adjacent entrance ramp and boarding/de-boarding and operator control platform, which platform includes an area in which the operator control unit or console is located and from which the operator controls boarding/de-boarding and operation. An optional vibrator may be installed on or about the passenger containment or compartment section of the modified dump trailer. Optional exterior lights and theming may also be installed.

DETAILED DESCRIPTION OF THE INVENTION

Figure 2:
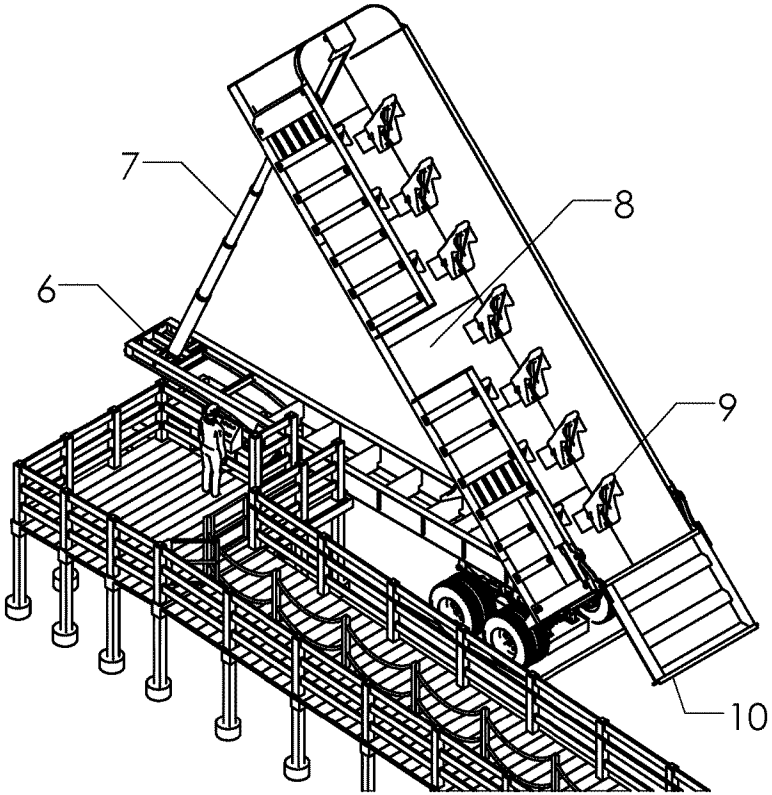
FIG. 2 shows a perspective overhead, angled view of the embodiment of FIG. in an elevated position with open/deployed tail gate.
Figure 1:
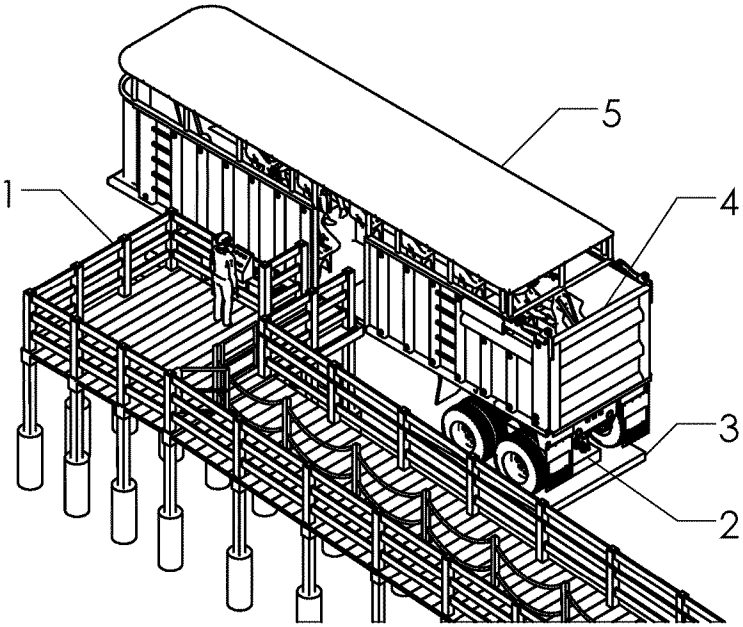
FIG. 1 shows a perspective overhead, angled view of an exemplary embodiment according to the invention in a lowered position.

Objects, embodiments and elaborations of the invention and systems and methods for powering, controlling and conducting the invention are summarized, with references to the drawings, as follows:

FIG. 1 and FIG. 2 show the amusement ride comprises a stationary-location 2, 3 dump trailer 4, 15 with passenger seating 8, 45 and optional canopy 5, 152. The dump trailer's body 81 is supported by the trailer frame, 15, 55, which is supported by the dump trailer's front axle jack 12, 58, 127 support structure 128-132 and rear axle 92 jack 91 support structure 90 on a steel support beam 116 supported by steel anchors 121 attached to a concrete foundation 62, 79, 88. From a platform 1, 38, 47 adjacent to the ride, an individual operator may generally observe the ride and operate the operator control unit or console 46 and passenger queue line entrance 49 gate 48 and exit 51 gate 50 and manage and control the flow of waiting, boarding, de-boarding and disembarking passengers. The front end 20, 81 of the dump trailer's body 81 is raised 7, 20 and lowered 52, 67 by a horizontally-pivoting 6 telescoping hydraulic cylinder 7 connected 20 to the dump trailer's underside 20. An optional electric 11 (or otherwise powered) vibrator 156 may be installed on or about 155 the underside of the dump trailer's body 157. The dump trailer body's tail gate 4, 10, 18 is opened and closed by two (e.g., left and right) hydraulic cylinders 22 to afford a view from inside the passenger seating area 8, 9 through the dump trailer body's open/deployed tail gate opening 10.

Figure 3:
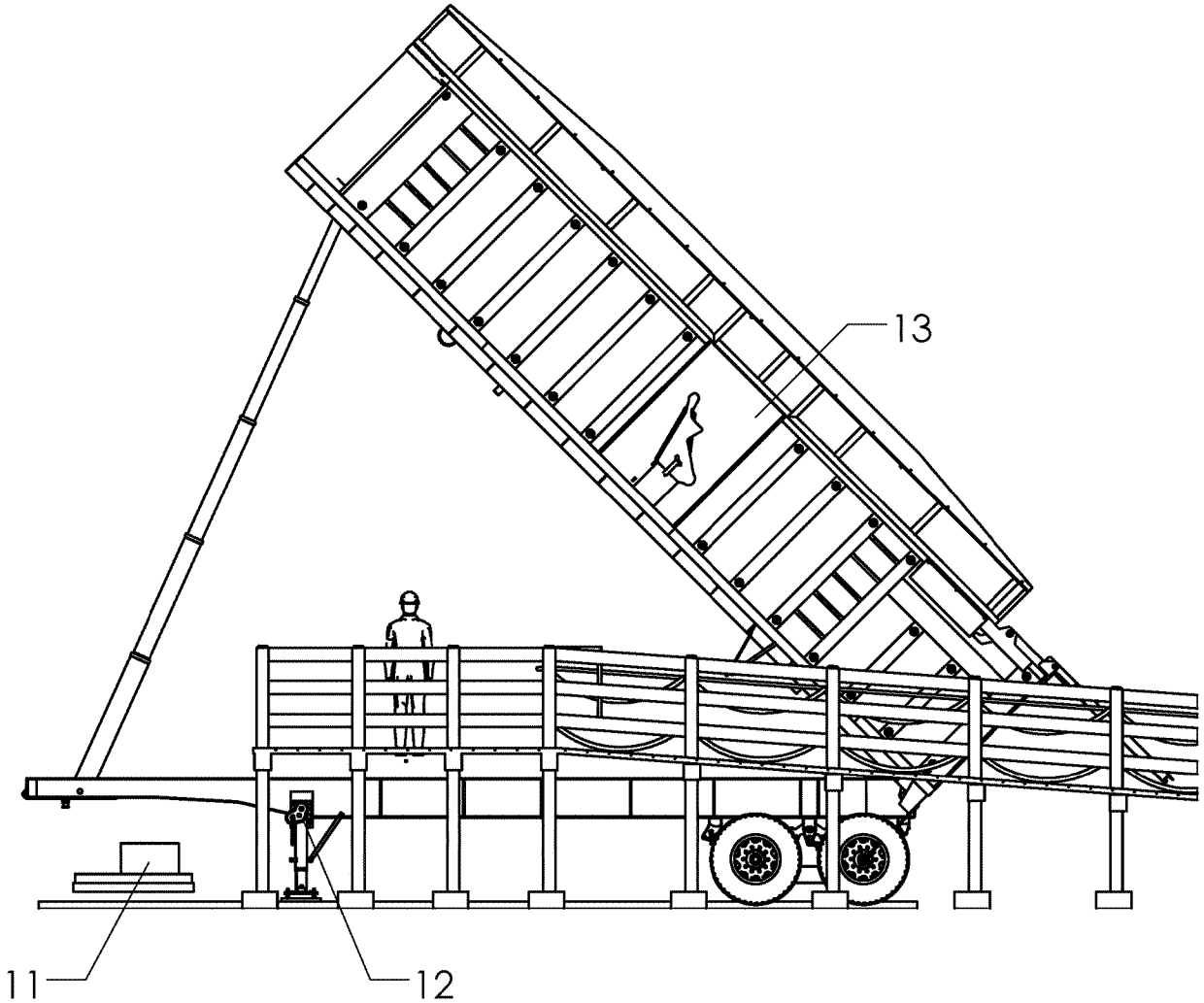
FIG. 3 shows a side view of the embodiment of FIGS. 1 and 2.

FIG. 2 and FIG. 3 show the modified dump trailer 4, 15 including its horizontally-pivoting 6, 7 telescoping hydraulic cylinder 7, and its support 90, 91, 116, 127, seating 8, 45, power pack 11, operator control unit or console 46 and other components may be fabricated and assembled using original equipment manufacturer (OEM) equipment, components or products; the canopy 5, 152 material may be canvas, vinyl, mesh or other OEM product or material; the canopy frame 149, 150, 154 material may be tubular steel or other OEM product or material; the platform 1, 38, 47, entrance 49 gate 48 and exit 51 gate 50 may be constructed from lumber, engineered wood products or other OEM products or materials; gate 48, 50 hinges may be OEM products; and platform and entrance/exit ramp support structures 33-36, 40, 62, 63, 79, 84, 85, 88 may be constructed from OEM concrete or other products, which OEM equipment, components, products or materials, in each case, may be the same as or similar to those depicted, described or referenced herein as preferred or example objects, embodiments and elaborations of the invention and systems and methods for powering, controlling and conducting the invention.

Figure 4:
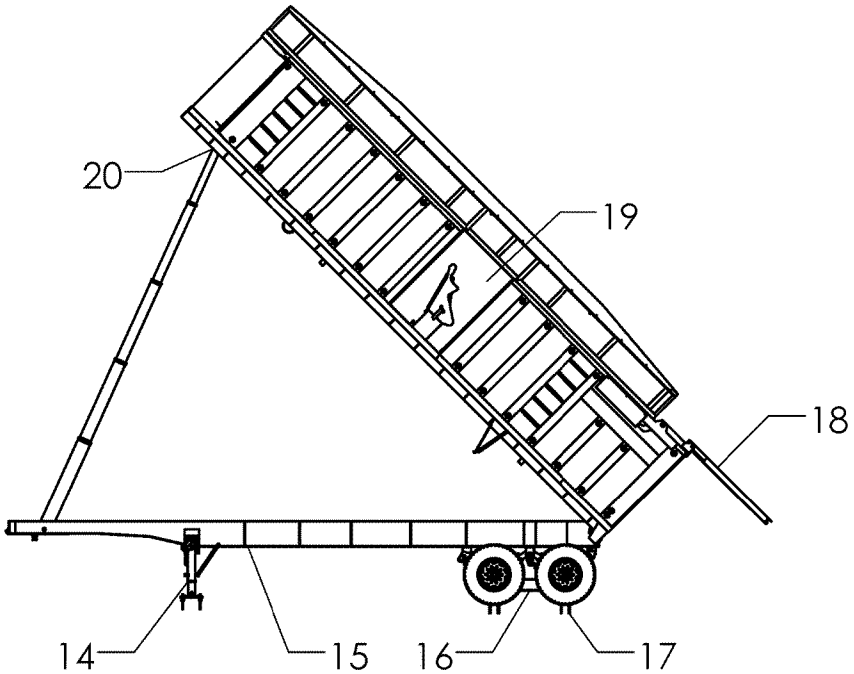
FIG. 4 shows a side view of the embodiment of FIGS. 1 and 2.

Other and additional objects, embodiments and elaborations of the invention and systems and methods for powering, controlling and conducting the invention are apparent from the foregoing, and from the following description, which illustrates objects, embodiments and elaborations of the invention and systems and methods for powering, controlling and conducting the invention, with references to the drawings, as follows:

FIG. 3 and FIG. 4 show the modified dump trailer is a stationary-location 2, 3 dump trailer 4, 15 with passenger seating 8, 45 and optional canopy 5, 152. The dump trailer's body 81 is supported by the trailer frame, 15, 55, which is supported by the dump trailer's front axle jack 12, 58, 127 support structure 128-132 and rear axle 92 jack 91 support structure 90 on a steel support beam 116 supported by steel anchors 121 attached to a concrete foundation 62, 79, 88. (Optional exterior chassis, frame, body or elsewhere-attached lights and theming, not shown, may be installed.)

Although in typical commercial or industrial use, a dump trailer has its body raised and lowered by a horizontally-pivoting telescoping hydraulic cylinder for which hydraulic power is provided by a pump powered by the truck/tractor engine, with respect to objects, embodiments and elaborations of the invention and systems and methods for powering, controlling and conducting the invention having no truck/tractor, it is a power pack 11 or other dedicated source of energy that supplies power to operate (a) a pump, valve or similar device to deliver pressurized fluid to a fluid-operable actuating or load-sustaining horizontally-pivoting 6 telescoping hydraulic cylinder 7 that raises 7, 20 and lowers 52, 67 the front end 20, 81 of the dump trailer's body 81, (b) each pump 22 that supplies hydraulic pressure to each hydraulic cylinder 22 that when actuated opens and closes the dump trailer body's tail gate 4, 10, (c) the operator control unit or console 46 to which (i) the control valve to deliver pressurized fluid to a fluid-operable actuating or load-sustaining horizontally-pivoting 6 telescoping hydraulic cylinder 7 is connected and from which it is operated, (ii) any optional electric 11 (or otherwise powered) vibrator 156 typically installed on the dump trailer body 155 is connected and from which it is operated, and (iii) any optional lighting or theming or other components that require power to operate are connected and from which they are or would be operated.

The dump trailer body 8, 81 is at the lowered 52, 67 position at the start and end of the ride FIG. 1. (An optional boom level indicator, not shown, may be installed and in the operator's field of view to aid the operator's determination that the dump trailer body is or has been fully leveled/lowered to 0° (zero degrees) FIG. 1.)

From a platform 1, 38, 47 adjacent to the ride FIG. 1, FIG. 2, an individual operator may generally observe the ride 45 and operate the operator control unit or console 46 and passenger queue line entrance 49 gate 48 and exit 51 gate 50 and manage and control the flow of waiting, boarding, de-boarding and disembarking passengers. (One platform 47 may comprise areas for both the operator control platform 47 area adjacent to the ride and passenger boarding/de-boarding platform 47 area adjacent to the ride.)

Figure 5:
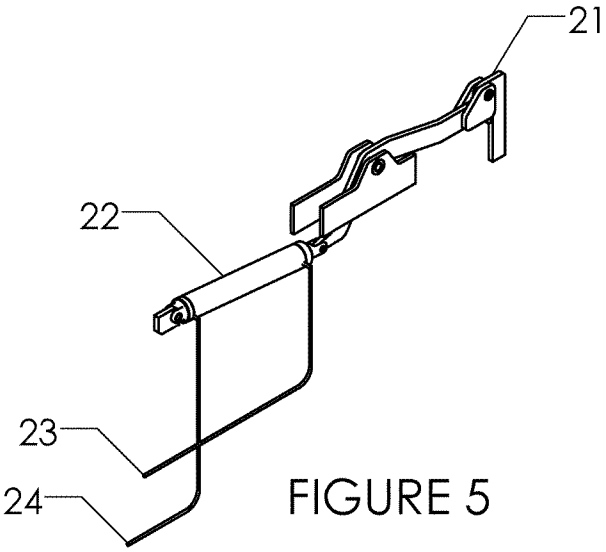
FIG. 5 shows a perspective angled close-up view of an exemplary embodiment of one of the two (e.g., left and right) hydraulic cylinders that when actuated open and close the dump trailer body's tail gate.

During the ride, the dump trailer body 81, and thus the passenger seating area 8, is raised 7, 20 from, then lowered 52, 67 to, the starting FIG. 1 and ending FIG. 2 positon by a horizontally-pivoting 6, 7 telescoping hydraulic cylinder 7. Also during the ride, the dump trailer body's tail gate 4, 10, 18 is opened and closed by two (e.g., left and right) hydraulic cylinders 22 (FIG. 5) to afford a view from inside the passenger seating area 8, 9 through the dump trailer body's open/deployed tail gate opening 10. Also during the ride, the dump trailer body may be vibrated by an optional electric 11 (or otherwise powered) vibrator 156 typically installed on or about 155 the underside of the dump trailer's body 157.

Figure 6:
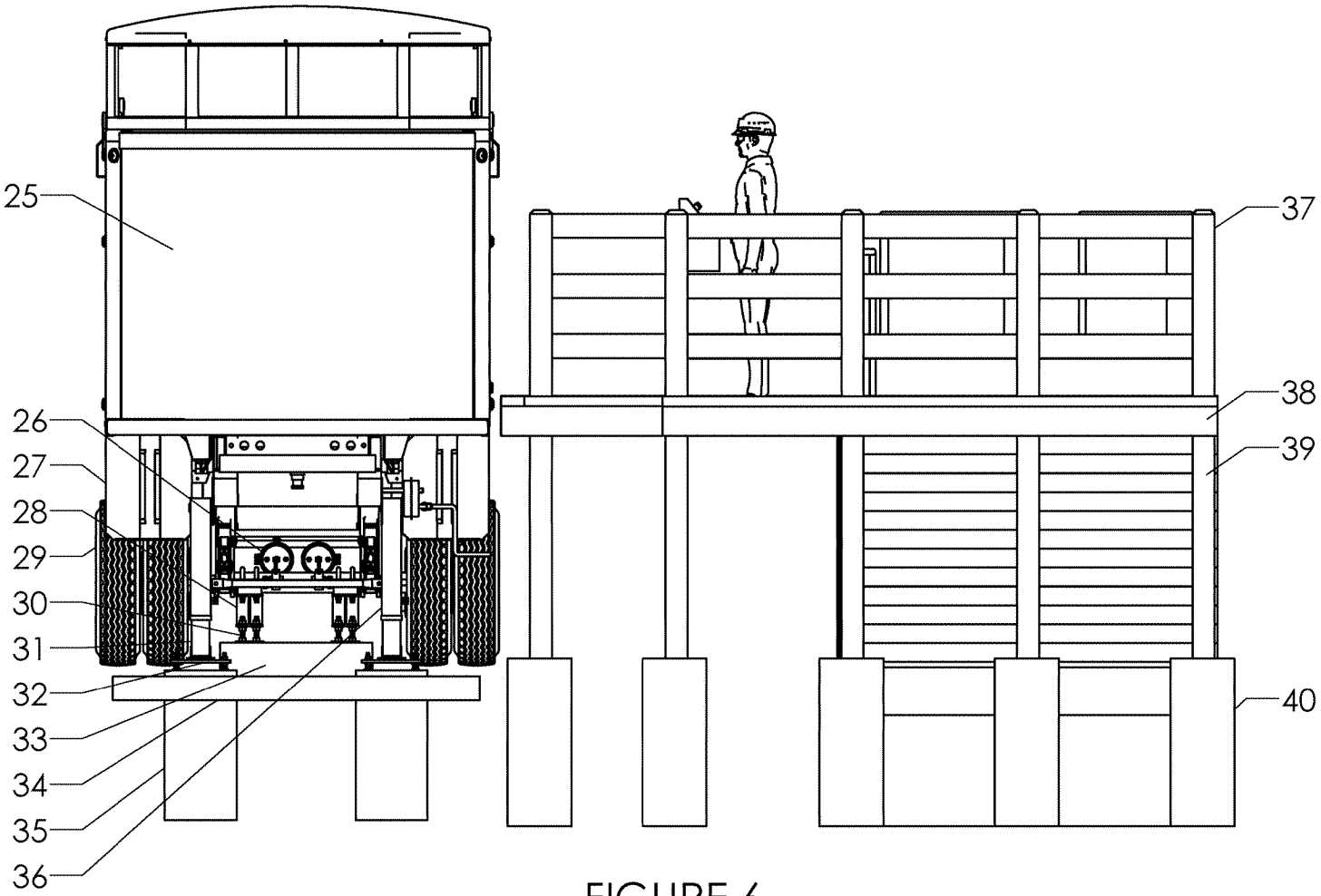
FIG. 6 shows an elevational view of the front of the dump trailer ride.

FIG. 6 shows the below-grade supporting structure of the dump trailer 33-36, 40, 62, 63, 79, 84, 85, 88 and the adjacent platform 38, 47 (which comprises areas for both the operator control 46 platform 38, 47 area adjacent to the ride and the passenger boarding/de-boarding platform 38, 47, entrance 49 gate 48 and exit 51 gate 50) is a system of support posts 37, 39 on top of piers 40 on top of footings 40. One preferred embodiment has concrete piers 40 and footings 40 and wood platform 38, 47 areas and entrance 49 gate 48 and exit 51 gate 50.

Figure 8:
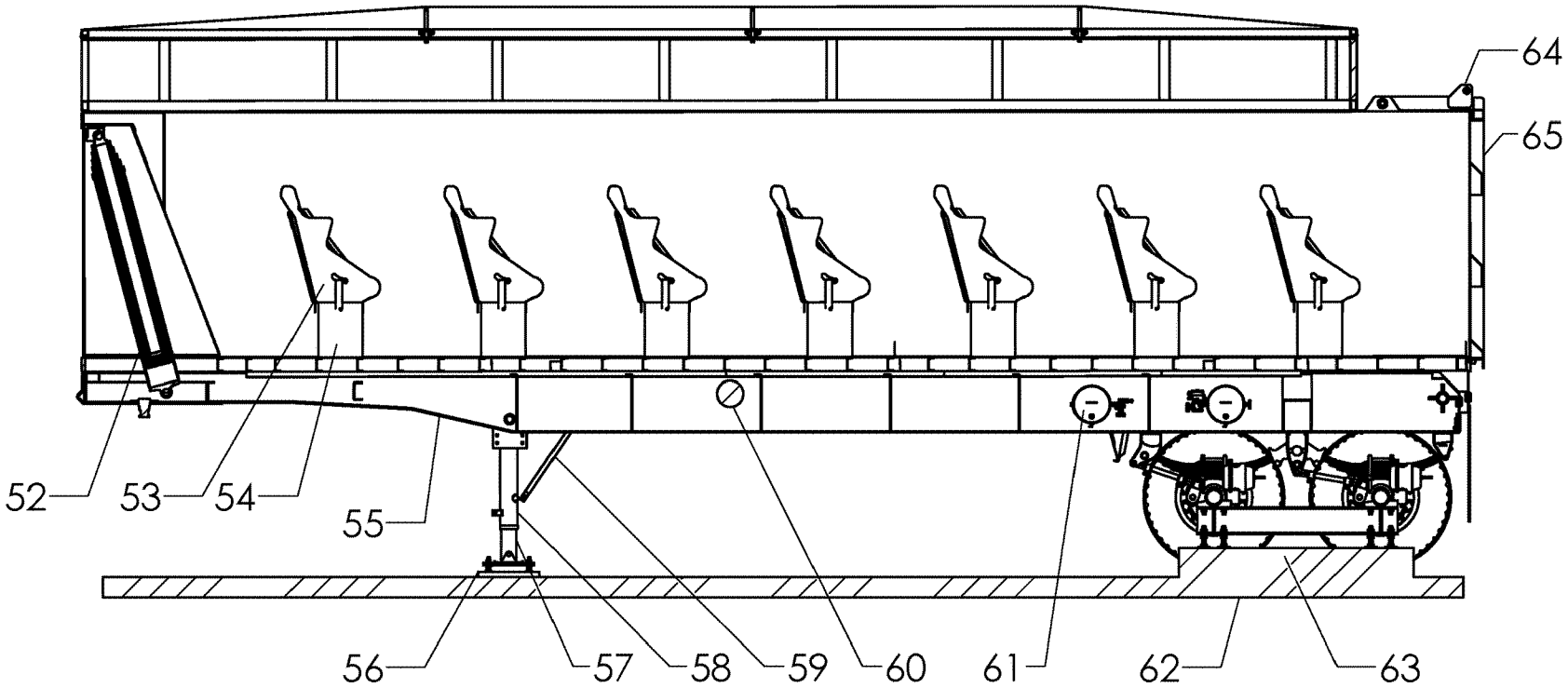
FIG. 8 shows a cutaway, side elevational view of the interior of the embodiment shown in FIG. 1.
Figure 9:
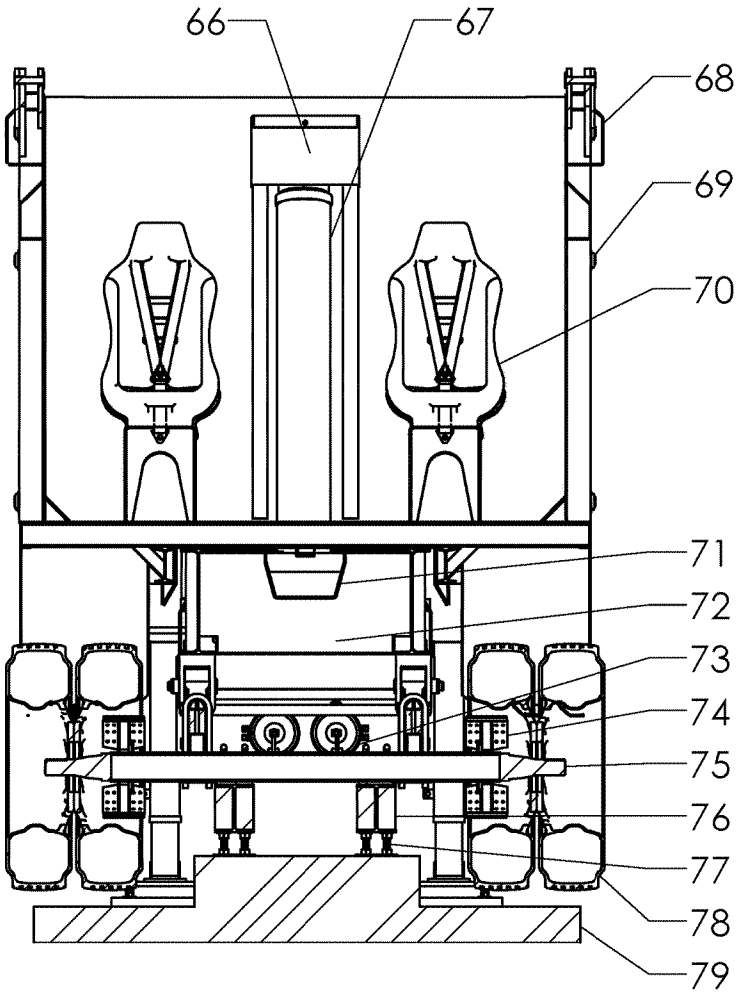
FIG. 9 shows a cutaway, front elevational view of the interior of the embodiment shown in FIG. 1.
Figure 10:
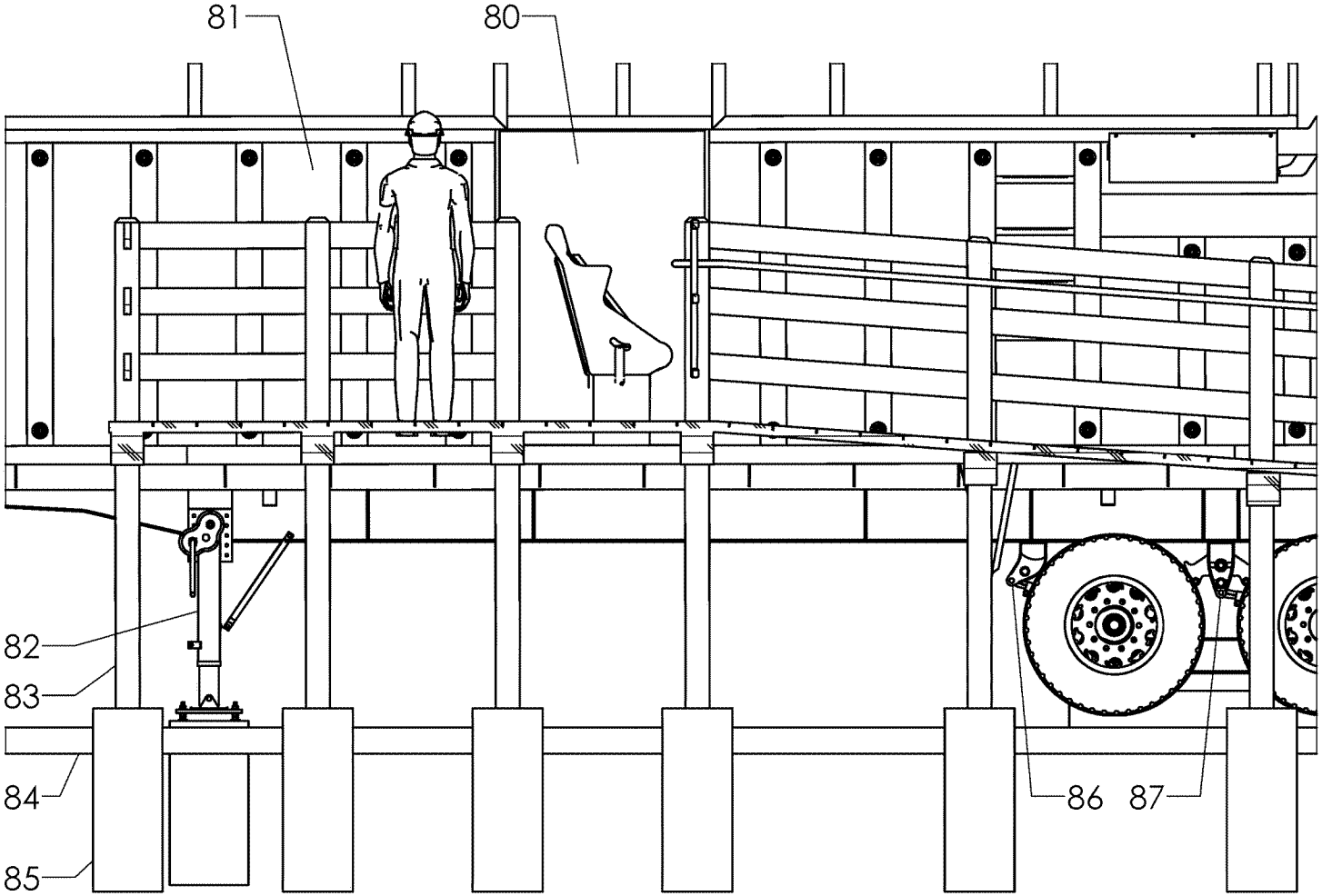
FIG. 10 shows another side elevational view of the embodiment shown in FIG. 1.
Figure 11:
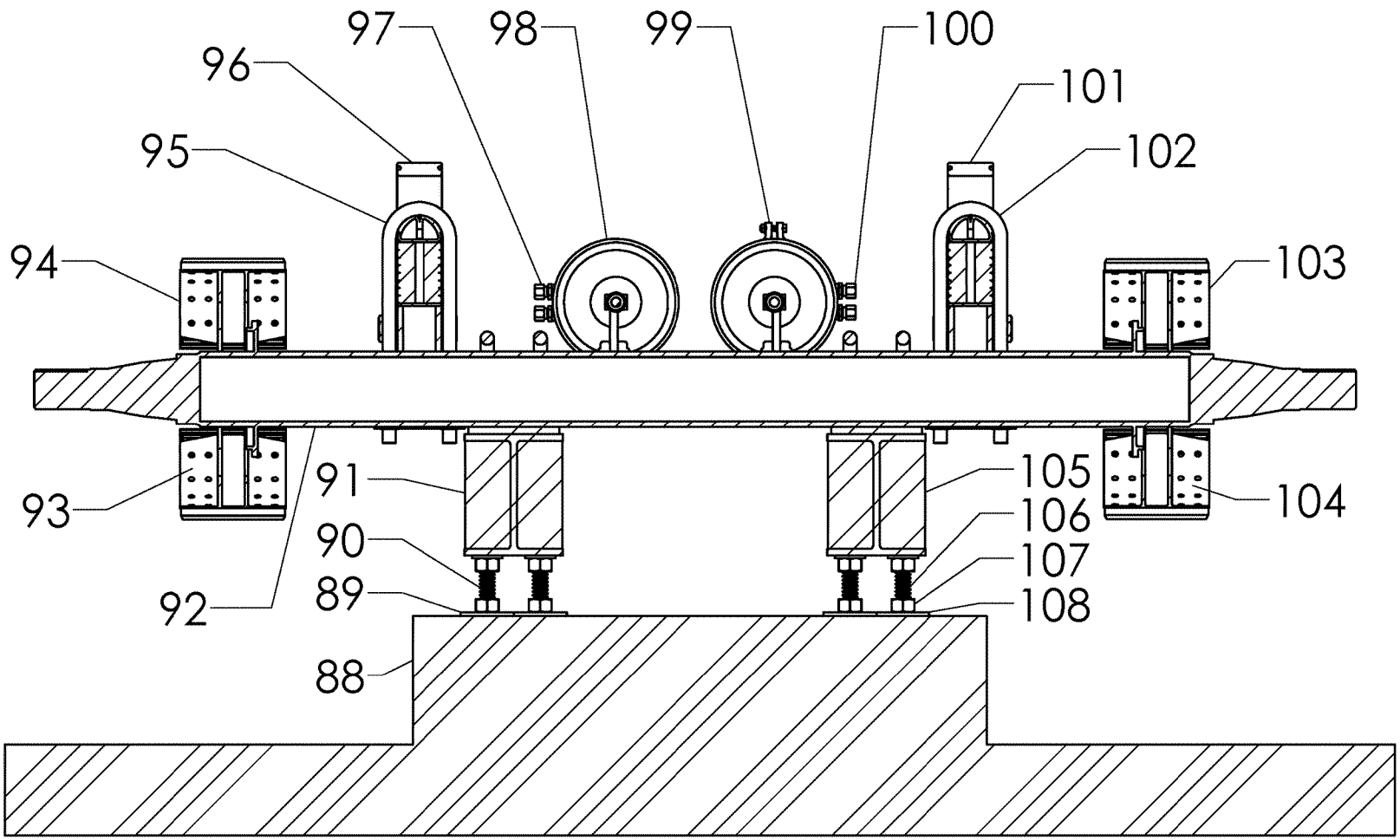
FIG. 11 is an elevational view of the dump trailer's rear axle supported by a rear axle jack.
Figure 12:
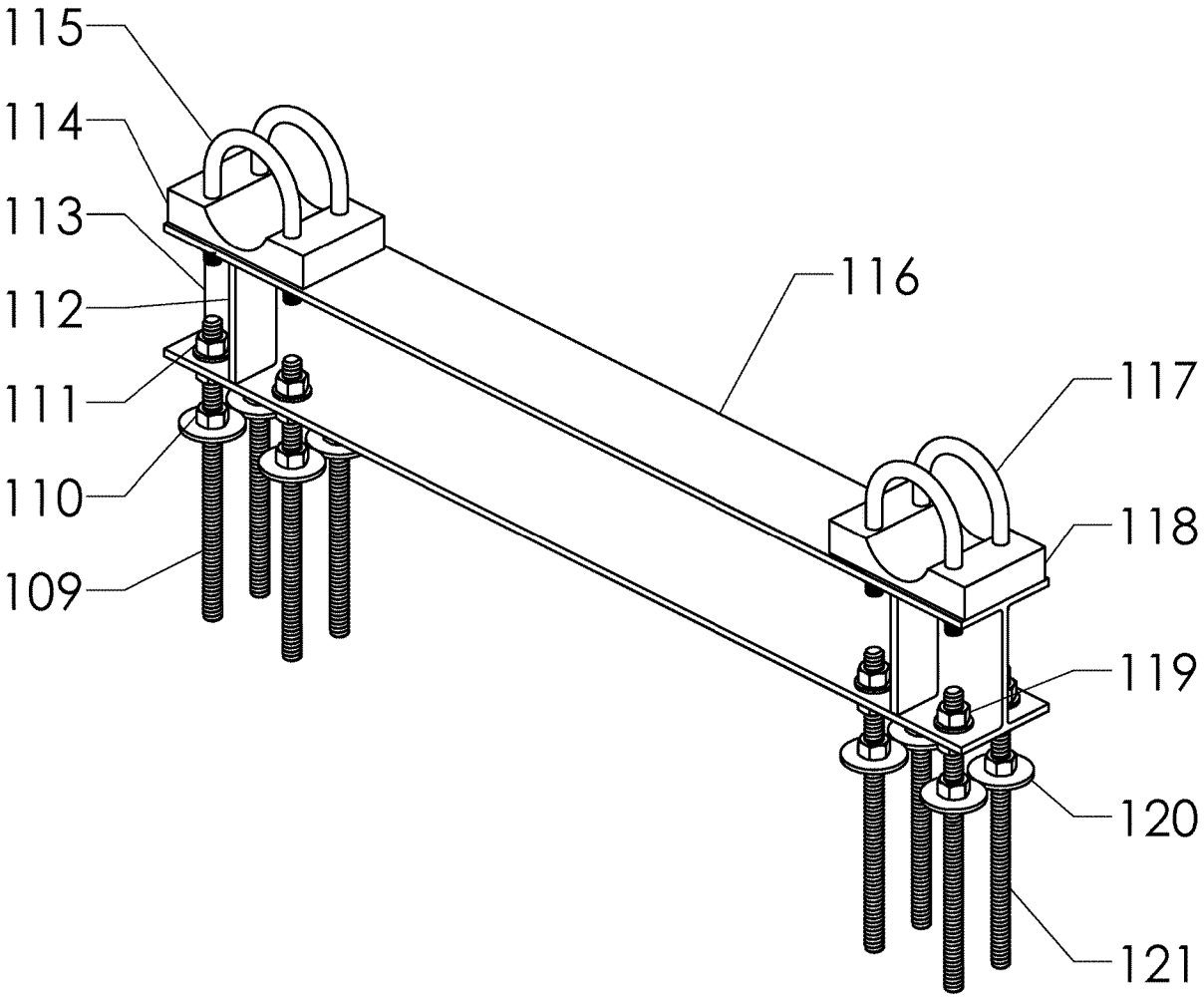
FIG. 12. Schematically shows a perspective view of an exemplary embodiment of the rear axle jack steel support beam with steel anchors.
Figure 13:
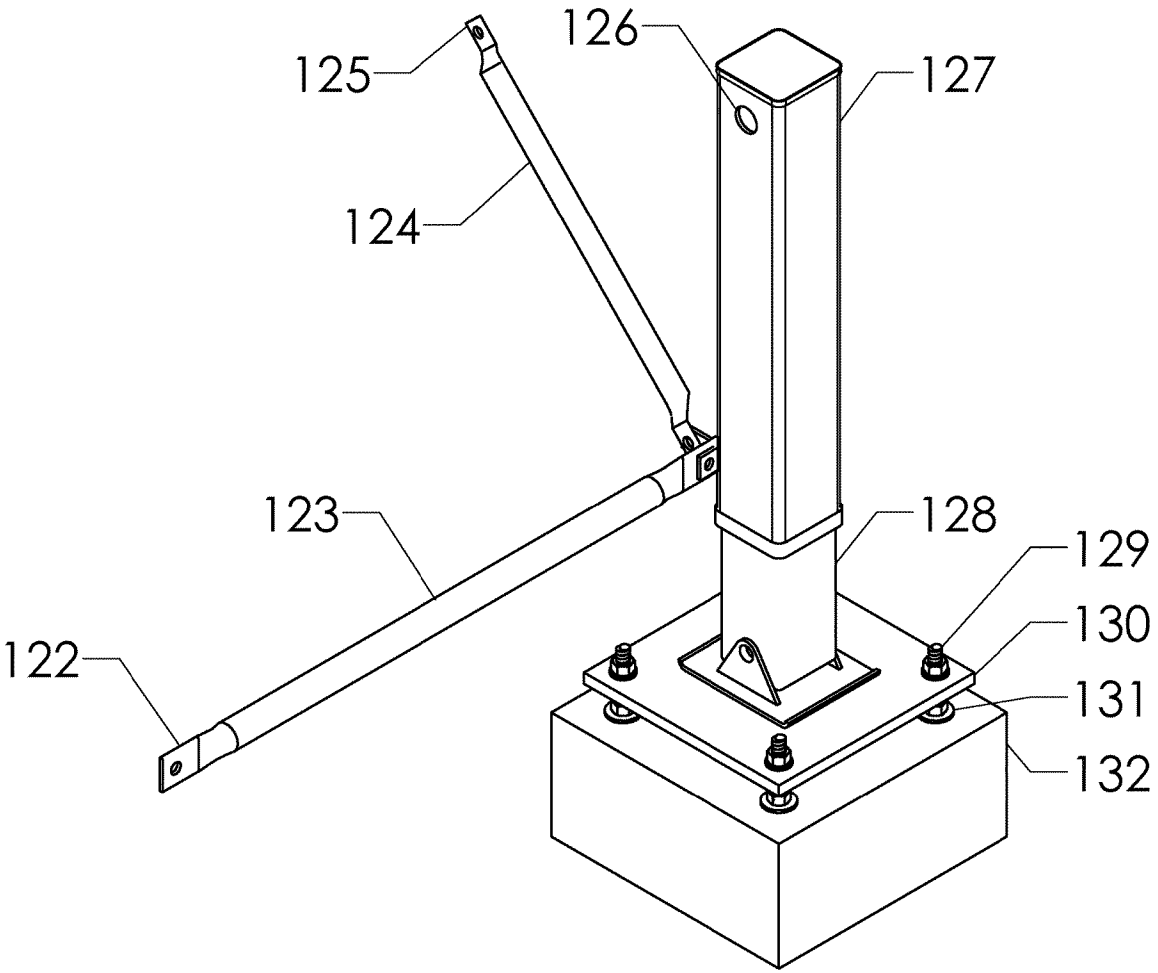
FIG. 13. Schematically shows a perspective side angled view of an exemplary embodiment of the dump trailer's front axle jack support structure used to support the front end of the dump trailer's frame.

FIG. 8, FIG. 9 and FIG. 10 show the front end 20, 81 of the dump trailer's body 81, which the horizontally-pivoting 6 telescoping hydraulic cylinder 7 raises 7, 20 and lowers 52, 67 during the ride, is supported by the trailer frame, 15, 55, which is supported by the dump trailer's front axle jack 12, 58, 127 support structure 128-132 situate on top of a concrete foundation 62, 79.

The rear end 45, 65 of the dump trailer's body 81 is supported by the trailer frame, 15, 55, which is supported by the dump trailer's rear axle 92 jack 91 support structure 90 on a steel support beam 116 supported by steel anchors 121 attached to a concrete foundation 62, 79, 88.

The rear end 45, 65 of the dump trailer's body 81 includes the dump trailer body's tail gate 10, 18 to which is attached each hydraulic cylinder 22 that when actuated opens 10, 18 and closes 4 the dump trailer body's tail gate 4, 10, 18. Each hydraulic cylinder 22 is connected 21 to the dump trailer's body 21, 64, 65 by mounting brackets 21 and to 23, 24 the power pack 11 or other dedicated source of energy that supplies power to operate each pump 22 that supplies hydraulic pressure to each such hydraulic cylinder 22.

Figure 7:
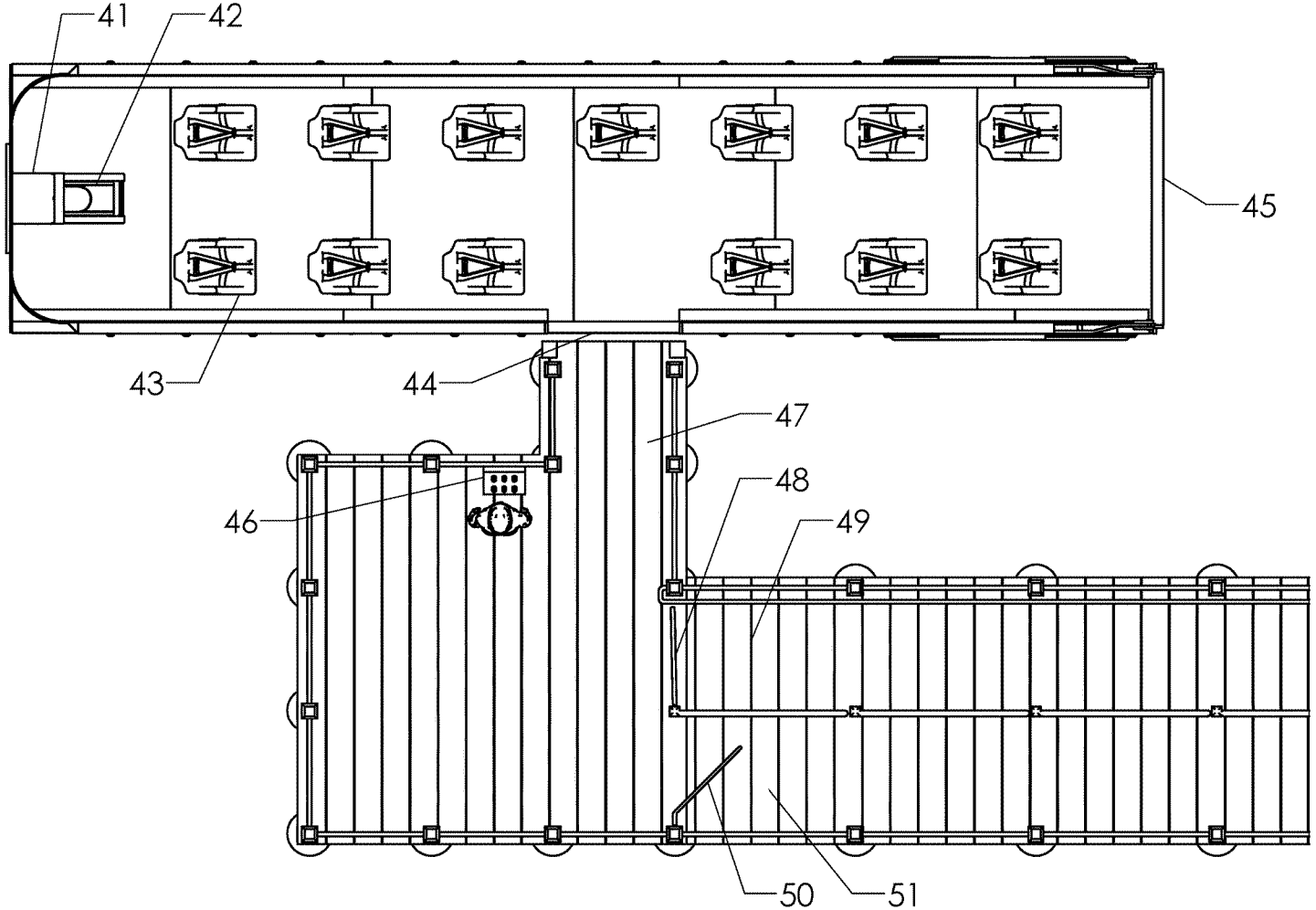
FIG. 7 shows an overhead plan view of the embodiment of FIG. 1 with the protective canopy removed.

FIG. 7 shows a ramp 49, 51 and platform 47 adjacent to the ride 45 include the passenger queue line entrance 49 gate 48 and exit 51 gate 50. The passenger queue line entrance ramp 49 is an incline to a level boarding platform 47. After the incline levels, and before the ride boarding area of the platform, is the passenger queue line entrance 49 gate 48. The passenger queue line entrance 49 gate 48 is used to assist in the management and control of the flow of waiting and boarding passengers. The platform 47 is used for boarding/de-boarding passengers. The passenger exit 51 gate 50 is used to assist in the management and control of the flow of the disembarking passengers. The operator opens the entrance 49 gate 48 to permit no more than the maximum number of passengers into the platform's 47 ride boarding area. Passengers board the ride (one at a time) through the modified dump trailer's side opening 44, 80, which remains open 13, 19 during the ride.

After either all passenger seats 8, 45 are occupied or no passengers remain in the passenger queue line 49 the operator closes the passenger queue line entrance 49 gate 48. One preferred embodiment does not require balancing or distributing passenger weight within the passenger seating area 8, 45.

Figure 15:
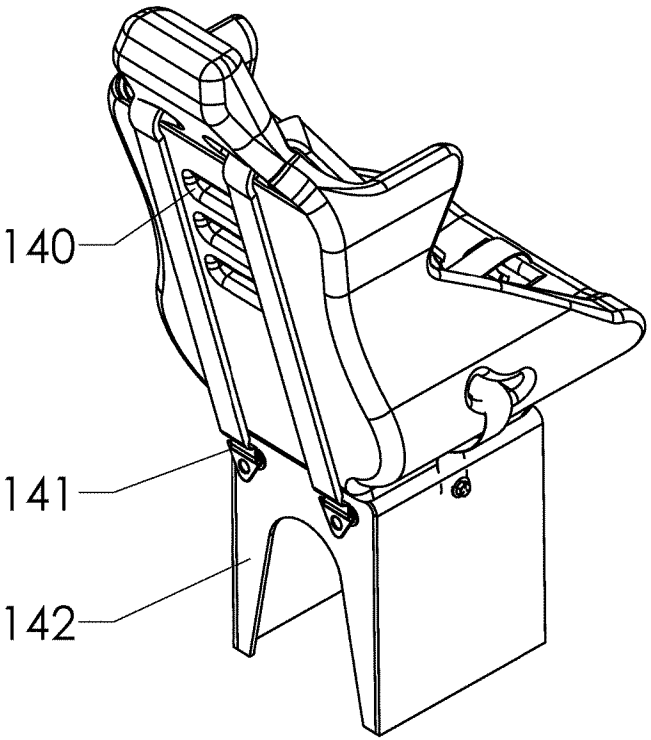
FIG. 15. Schematically shows a perspective rear angled view of an exemplary embodiment of one passenger seat, a seat pedestal mount for that seat and part of a passenger restraint system.
Figure 14:
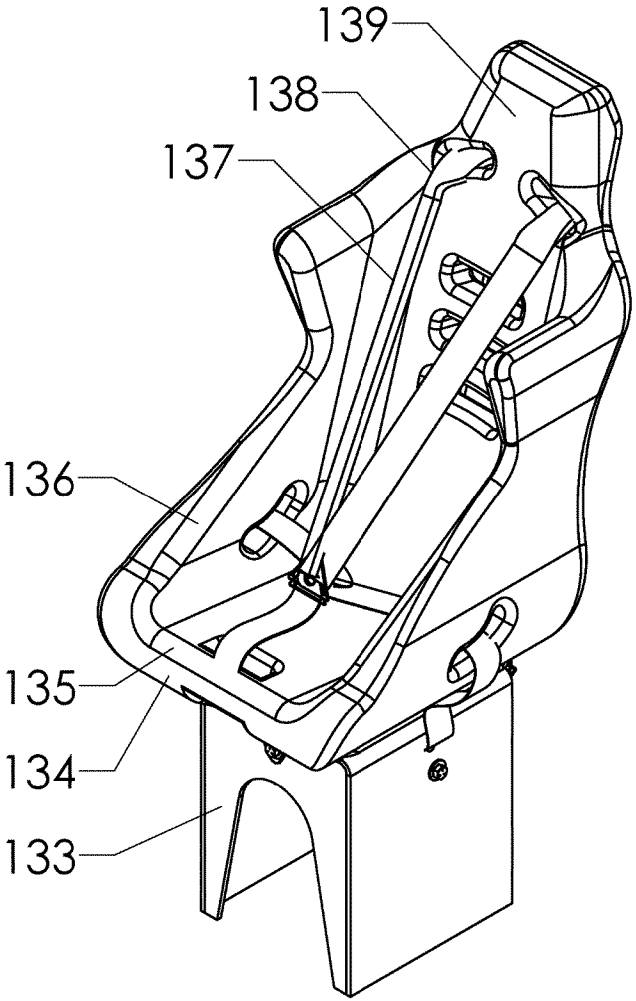
FIG. 14. Schematically shows a perspective side angled view of an exemplary embodiment of one passenger seat, a seat pedestal mount for that seat and part of a passenger restraint system.
Figure 18:
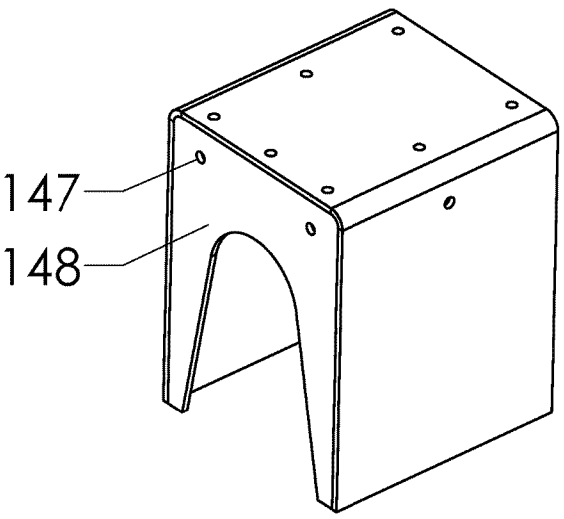
FIG. 18. Schematically shows a perspective overhead, angled side view of an exemplary embodiment of one seat pedestal mounting plate for one passenger seat and exemplary embodiments of mounting holes for securing the passenger seat and restraint system to the seat pedestal.
Figure 17:
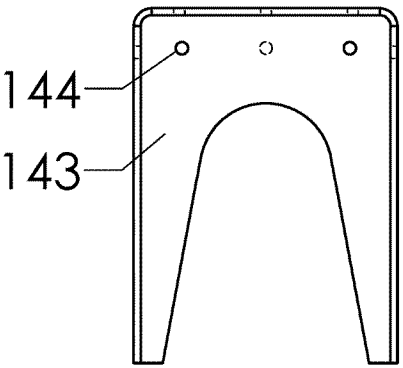
FIG. 17. Schematically shows a side view of an exemplary embodiment of one seat pedestal mounting plate for one passenger seat and exemplary embodiments of mounting holes for securing the passenger seat and restraint system to the seat pedestal.
Figure 16:
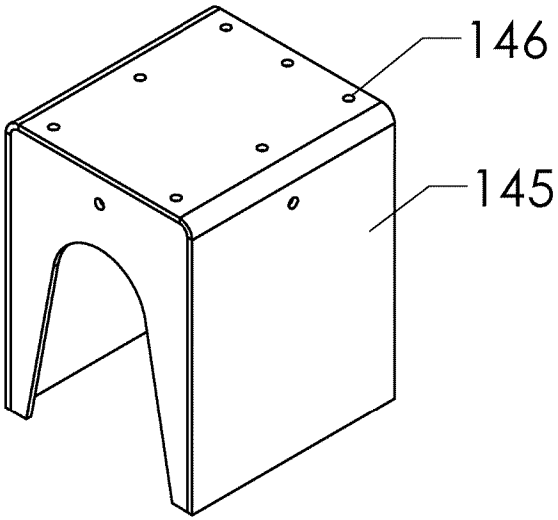
FIG. 16. Schematically shows a perspective overhead, angled side view of an exemplary embodiment of one seat pedestal mounting plate for one passenger seat and exemplary embodiments of mounting holes for securing the passenger seat and restraint system to the seat pedestal.
Figure 19:
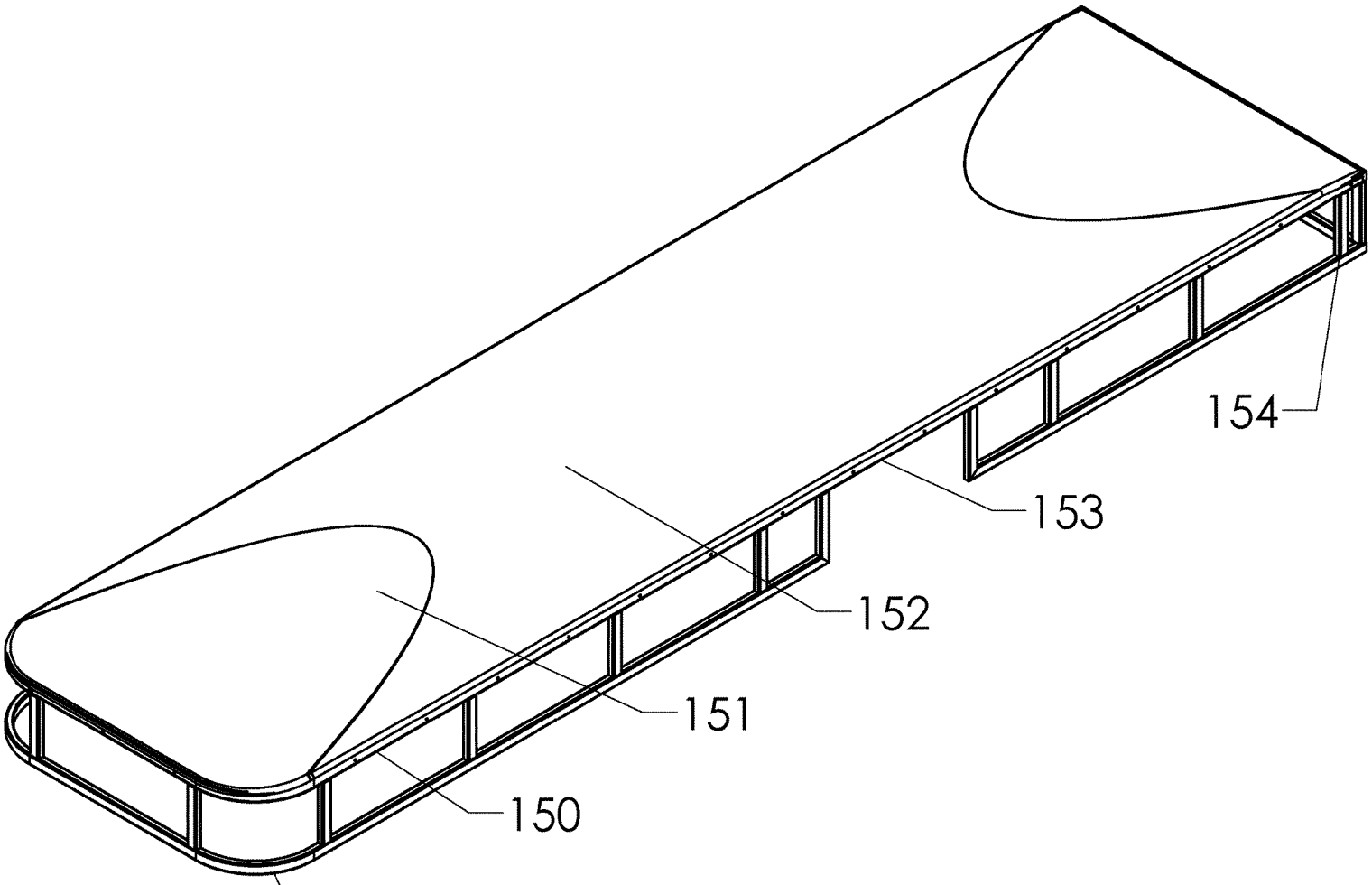
FIG. 19 shows a perspective overhead angled view of an exemplary embodiment of a passenger area shade or protective canopy.
Figure 21:
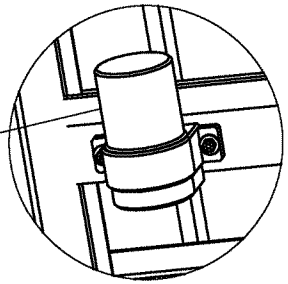
FIG. 21 shows a perspective view of a vibrator device which may be optionally mounted on the underside of the dump trailer.
Figure 20:
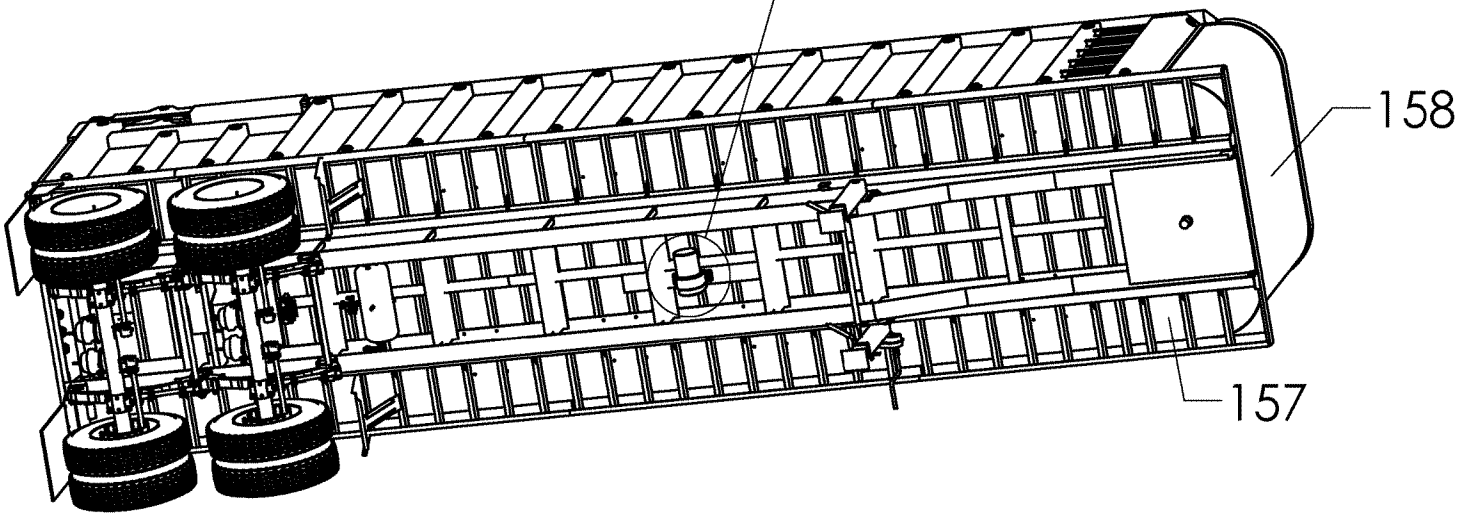
FIG. 20. Schematically shows a perspective grade-level, angled view, from under the dump trailer's underside, of the approximate location of the optional vibrator mounted on the dump trailer's underside.

FIG. 14 and FIG. 15 show each passenger seat 53, 139, 140 is mounted on and attached to a seat pedestal 54, 133, 142, 145. Mounting holes 144, 146, 147 for securing the passenger seat to the seat pedestal would typically be pre-drilled during pedestal fabrication.

Each passenger seat 139 includes a passenger restraint device 137. One preferred embodiment includes as the passenger restraint system a five-point seatbelt harness 137. Alternative passenger restraint devices for securing a passenger in a seat are known from prior art and may be suitable for securing a passenger in a seat according to the invention. The operator can visually verify that all passengers are properly seated and manually verify that each passenger's restraint is properly adjusted and secured.

The operator operates the ride from the operator control unit or console 46 located within the operator control platform 47 adjacent to the ride and therefrom may generally observe the ride and operate the operator control unit or console 46 and passenger queue line entrance 49 gate 48 and exit 51 gate 50 and manage and control the flow of waiting, boarding, de-boarding and disembarking passengers.

After the ride has come to a complete stop, and the operator has instructed the passengers to de-board, the exiting passengers de-board (one at a time) through the modified dump trailer's side opening 44, 80, re-enter the adjacent boarding/de-boarding platform 47 and continue across the platform to the front of the exit 51 gate 50. The operator opens the exit 51 gate 50 to permit egress from that section of the passenger de-boarding platform 47 through the exit 51 gate 50 and then down the decline exit ramp 51.

Although the tires and wheels 29, 78 and related systems and components (including the air brake system slack adjusters and air chambers 26, 73, 98, 99 and leaf springs 86, 87) are not necessary to or used in operation as a stationary-location dump trailer with passenger seating, they may be used to transport the dump trailer, and are therefore part of the invention because an object of the invention includes embodiments that are sufficiently mobile to be transported (including by any truck, tractor or other vehicle, machine, vessel or container, or any combination thereof) such as for use in or by a temporary or traveling carnival or amusement event or location.

The foregoing description and accompanying figures illustrate the principles, preferred or example embodiments, and modes of assembly and operation, of the invention; however, the invention is not, and shall not be construed as being exclusive or limited to the specific or particular embodiments set forth hereinabove. Moreover, certain specific or particular embodiments set forth hereinabove have been expressly designated optional, and thus the invention includes the invention with, or without, any or all embodiments expressly designated as optional hereinabove. Accordingly, the foregoing should be regarded as illustrative rather than exclusive or limiting, and that variations to the embodiments herein may be made without departing from the invention scope as defined by the following claims.

What is claimed is:

1. An amusement ride providing the sensation of riding a tilting dump trailer body to ride passengers, comprising:

a vehicle trailer frame with wheels connected thereto;

a stationary support structure supporting said frame and suspending said wheels in midair;

a pivoting dump trailer body mounted to one end of said frame, modified with an opening in a sidewall of said body to permit ingress and egress of ride passengers to said body's interior compartment;

an amusement ride seat mounted within said body's interior compartment;

a passenger restraint on said seat;

a hydraulic cylinder connected between said frame and the end of said body opposing said frame-mounted end;

an electrically powered hydraulic pump connected to said hydraulic cylinder;

a non-automobile based, stationary electric power supply powering said hydraulic pump; and a passenger access platform situated adjacent said opening, with a floor substantially even with the floor of said body's interior compartment.

2. The amusement ride of claim 1, further comprising an amusement ride operator control console on said passenger access platform controlling operation of said hydraulic pump.

3. The amusement ride of claim 2, further comprising an electrically powered motor controlled by said control console, which vibrates said trailer body when energized.

* * * * *